US006199658B1

(12) United States Patent
Huff

(10) Patent No.: US 6,199,658 B1
(45) **Date of Patent: *Mar. 13, 2001**

(54) MULTI-FOLD SIDE BRANCH MUFFLER

(75) Inventor: Ronald G. Huff, Westlake, OH (US)

(73) Assignee: JB Design, Inc., Berea, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/364,197

(22) Filed: Jul. 30, 1999

Related U.S. Application Data

(63) Continuation of application No. 09/009,341, filed on Jan. 20, 1998, now Pat. No. 5,952,625.

(51) Int. Cl.[7] ..... F01N 1/08
(52) U.S. Cl. ..... 181/265; 181/267
(58) Field of Search ..... 181/250, 251, 181/255, 257, 264, 265, 266, 267, 268, 269, 270, 272, 273, 274, 275

(56) References Cited

U.S. PATENT DOCUMENTS

| | | | | |
|---|---|---|---|---|
| 823,115 | * | 6/1906 | Gramm | 181/272 |
| 4,006,793 | | 2/1977 | Robinson . | |
| 4,046,219 | | 9/1977 | Shaikh . | |
| 4,185,715 | | 1/1980 | Reu Boiu . | |
| 4,220,219 | * | 9/1980 | Flugger | 181/272 |
| 4,557,349 | | 12/1985 | Crump . | |
| 4,790,409 | | 12/1988 | Deaver . | |
| 4,848,513 | | 7/1989 | Csaszar . | |
| 5,129,793 | | 7/1992 | Blass et al. . | |
| 5,168,132 | | 12/1992 | Beidl et al. . | |
| 5,350,888 | | 9/1994 | Sager, Jr . | |
| 5,413,189 | | 5/1995 | Browning et al. . | |
| 5,502,283 | | 3/1996 | Ukai et al. . | |
| 5,659,158 | | 8/1997 | Browning et al. . | |

* cited by examiner

*Primary Examiner*—Khanh Dang
(74) *Attorney, Agent, or Firm*—Vickers, Daniels & Young

(57) ABSTRACT

A compact muffler has a straight through inner cylindrical casing surrounded by an outer cylindrical casing defining a closed ended sound attenuating chamber therebetween. Within the outer chamber a plurality of axially extending, radially overlying, cylindrical intermediate casings form a plurality of annular sound attenuating passages. The sound passages are configured to have entrances in fluid communication either with an especially configured slot in the inner casing or between certain passages to define a plurality of discrete sound paths, with each sound path having a set length sufficient to generate a reflection wave for attenuating a sound wave having a frequency correlated to the distance of the sound path.

6 Claims, 13 Drawing Sheets

MULTI-FOLD SIDE BRANCH MUFFLER

This patent application is a continuation of application Ser. No. 09/009,341 filed on Jan. 20, 1998, now U.S. Pat. No. 5,952,625, and incorporated herein by reference.

This invention relates generally to mufflers of the sound modifying type used with internal combustion engines to attenuate engine noise and more particularly to mufflers conventionally referred to as side branch mufflers.

The invention is particularly applicable to and will be described with specific reference to a straight through muffler for use in sports cars or high performance automotive vehicles. However, it will be appreciated by those skilled in the art that the inventive concepts disclosed herein may be utilized for any number of muffler applications and in combination with or as part of other muffler systems or concepts for attenuating a specific or a specific range of sound waves.

INCORPORATION BY REFERENCE

The following patents do not form any part of this invention but are incorporated by reference as indicative of the muffler art so that details known to those skilled in the art need not be repeated herein:

A) U.S. Pat. No. 5,659,158 to Browning et al., entitled "Sound Attenuating Device and Insert", issued Aug. 19, 1997;

B) U.S. Pat. No. 5,502,283 to Ukai et al., entitled "Muffler", issued Mar. 26, 1996;

C) U.S. Pat. No. 5,350,888 to Sager, Jr. et al., entitled "Broad Band Low Frequency Passive Muffler", issued Sep. 27, 1994;

D) U.S. Pat. No. 5,129,793 to Blass et al., entitled "Suction Muffler", issued Jul. 14, 1992; and, E) U.S. Pat. No. 4,006,793 to Robinson, entitled "Engine Muffler Apparatus Providing Acoustic Silencer" issued Feb. 8, 1977.

BACKGROUND

Engine noise in an internal combustion engine typically is generated by the sudden expansion of combustion chamber exhaust gases. As the combustion gases are exhausted from each cylinder of the engine, a sound wave front travels at rapid sonic velocities through the exhaust system. This wave front is the boundary between the high pressure exhaust pulse and ambient pressure. When the sound wave front exits the exhaust system, it continues to pass through the air until three dimensional diffusion causes it to eventually dissipate. As the wave front passes an object, an overpressure is created at the surface of the object, and it is this overpressure that is a direct cause of audible and objectionable noise.

Since the inception of the internal combustion engine, efforts have been underway to reduce or muffle the noise caused by the engine. Obviously, considerable noise attenuation or reduction can be achieved in a muffler having dimensions that are large enough to permit three dimensional dissipation of the sound waves within the muffler housing. However, from a practical standpoint, design criteria often dictate the size of the muffler which must be kept as small as possible. Further means of attenuating engine noise include the use of packing and complex baffle systems. However, these approaches are often accompanied by a substantial increase in the back pressure or resistance of the muffler to the free discharge of the combustion gasses. The increase in backpressure can result in a decrease in the output horsepower of the engine with a resulting loss of efficiency in fuel economy.

Mufflers are classified in various manners within the art. From a structural consideration, mufflers have been classified as being either of two basic types or configurations:

i) a compartmentalized type which comprises several compartments sealed except for the inlets and outlets, the compartments usually being sealed, noise entrapment chambers; or, ii) a type commonly known as a straight through muffler which usually comprises a duct having a series of perforations within a sealed housing.

In accordance with this classification, this invention is particularly adaptable to mufflers of the straight through type although, it could have application to compartmentalized type mufflers.

From a functional view, mufflers may be classified as dissipative or reactive. Dissipative mufflers are typically composed of ducts or chambers filled with acoustic absorbing materials such as fibre glass, steel wool or even porous ceramics. Such materials absorb acoustic energy and transform it into thermal energy. Reactive mufflers, on the other hand, are composed of a number of inner connected chambers of various sizes and shapes in which sound waves are reflected to dampen or attenuate waves of a set frequency, typically resonance frequency. This invention relates to a reactive type muffler.

There are two types of reaction mufflers, a side branch type muffler and a resonator type muffler. A resonator type muffler uses various volumes of different shapes or sizes, i.e., resonance chambers, interconnected with pipes and can dampen not only resonance frequency but also sound waves having frequencies near the resonance frequency. The drawback to resonator mufflers is the large volume required to dampen low frequency sound waves.

The side branch muffler is the type of muffler to which this invention relates. Generally, the side branch muffler has a straight through pipe and an offset or a side branching off the straight through pipe. The side branch is closed at its end and may be bent or shaped with baffles as shown in some of the patents incorporated by reference herein. When the sound wave reaches the closed end of the side branch, it reflects back towards the open end damping waves at the same frequency and out of phase with the reflected wave. The side branch muffler possesses an advantage over the resonator type muffler in that a large volume is not required to dampen any sound wave of a given frequency. However, low frequency sound waves which produce the most objectionable noise require long, side branch lengths which make it difficult to fit within the confines of certain automotive applications.

Apart from the functional and structural discussion above, sports cars and high performance vehicles have additional requirements. It has long been known that the exhaust systems of such vehicles must be tuned to emit certain sounds from the automobile which appeal to the purchaser of such vehicles while satisfying noise regulations. Such applications require attenuation of specific waves having set frequencies to produce the desired sound. More particularly, high performance mufflers of the type under discussion are tuned to the specific type of engine to which the muffler will be applied to. Specifically, the valving or breathing characteristics of the engine are matched to the muffler over the operating range of the engine to produce the desired tone. Recent engineering advances in the structural rigidity of the body or chassis of the vehicle in which the engine is mounted have enhanced the sound of the engine within the cabin of the vehicle. Specifically, a muffler could be tuned to a desired sound with the engine on a test stand, but produce objectionable resonance in the cabin. Since the cabin cannot be dampened, the muffler has to be precisely tuned to attenuate the sound waves producing the objectionable resonance within the cabin.

The side branch type muffler, in theory, has the ability to resolve this problem. However, until this invention, the approach followed was random and haphazard and simply involved reconstructing entirely different side branch designs until one resulted in the removal of the objectionable noise. Unfortunately, the length of the side branch typically exceeded the space limitations for the muffler design.

SUMMARY OF THE INVENTION

Accordingly, it is a principle object of the invention to provide a side branch type muffler which can be readily tuned to produce any desired sound in a compact design avoiding the space limitations afflicting conventional side type mufflers.

This feature along with other objects of the invention is achieved in a muffler for an internal combustion engine with an inlet and an outlet and an inner cylindrical casing axially extending from the inlet through the outlet and defining an open ended inner chamber contained therein through which the exhaust gases pass. An outer concentric casing with axial end sections is spaced radially outward from the inner casing and defines therebetween a closed end outer chamber. A slotted opening arrangement at a set axial position provides fluid communication between the inner and outer chamber. A sound attenuating arrangement within the outer chamber includes a plurality of intermediate, cylindrical casings which axially extend substantially the length of the outer chamber and are radially spaced to overlie one another so that each pair of radially adjacent casings forms an annular, axially extending sound attenuation passage. Each sound passage has an entrance in fluid communication with a pressure wave at one end thereof and a sound reflection wall at its opposite end to establish a second path therebetween. Certain select sound passages have an entrance in fluid communication with the slotted opening while other sound passages have an entrance in fluid communication with an adjacent sound passages whereby a plurality of sound passages having various sound path lengths is produced for reflecting and attenuating a plurality of sound waves at set frequencies, particularly sound waves of low frequency.

In accordance with another important feature of the invention, the sound wave arrangement further includes at least one annular stop plate extending within a selected sound passage between radially adjacent intermediate casings forming the selected sound passage. The stop plate is positioned at a set axial distance within the selected sound passage correlated to the axial distance a sound wave travels from a passage entrance to the stop plate whereby any sound wave of any specific frequency may be attenuated by positioning the stop plate at a set axial distance in a sound passage thus permitting the muffler to be tuned to any desired sound.

In accordance with a specific feature of the invention, the selected adjacent passages in fluid communication with one another are limited in number, preferably not to exceed three, to assure isolation and attenuation of specific sound waves at set frequencies without undue interference from other reflected waves of different frequencies.

In accordance with an important feature of the invention, the axial spacing of the slotted opening arrangement is at least equal to the radial spacing between adjacent intermediate casings to permit energy transmission of the sound waves in the sound passages. Still further, the axial distance of the entrance of each sound passage is at least equal to the radial distance between adjacent casings to likewise permit energy transmission of the sound waves in the sound passages. Importantly, the volume of each sound passage, which is sized large enough to transmit the wave's energy, is maintained approximately equal for all sound passages by successively decreasing the radial height for successively larger diameter sound passages to avoid pressure undulations and accompanying sound wave variations as the waves travel in a sound path from one sound passage to another sound passage.

In accordance with yet another specific but important feature of the invention, the slotted opening arrangement includes the inner casing having a first section secured to the inlet and a second section secured to the outlet with each section having an open end facing the other and axially spaced from one another a set distance to define an annular, axially extending slot whereby pulse waves produced by the exhaust gases are transmitted from the inner chamber to the outer chamber without encountering any obstruction which would otherwise adversely affect the power of the sound waves.

In accordance with yet another feature of the invention, the muffler has at least two divider plates axially extending from the inlet to the outlet and radially extending from the inner casing through the intermediate casings to the outer casing to divide the plurality of sound passages completely circumscribing the inner casing into at least two pluralities of sound passages partially circumscribing the inner casing, each plurality of divided passages functioning as a separate muffler. The arrangement of the entrances of the sound passages in one of the separate mufflers is different than that of the other muffler so that the axial length of the sound paths through adjacent sound passages for certain sound passages in one muffler is different than those in the other muffler thus increasing the number of sound paths of different lengths for sound wave attenuation by reflection.

In accordance with yet another important feature of the invention, every other intermediate casing is affixed to a radial end wall of the outer casing and each intermediate casing between each affixed intermediate casing is suspended by radial spacers therebetween and fixed by an annular passage closing plate adjacent the slotted opening whereby a compact, folded side branch muffler having long effective branches results in a rigid muffler which can be easily assembled.

In accordance with still another feature of the invention, the muffler includes first and second mufflers as described connected in series by an extension pipe secured to the outlet of the first muffler's inner casing and the inlet of the second muffler's inner casing. The extension pipe may be folded back at 180 degrees into a U shape to transversely align the first and second casings thereby maintaining the axial distance of the muffler at a minimum while further increasing the plurality of sound waves which can be separately attenuated by the muffler.

It is thus an object of the invention to provide a compact muffler having a plurality of folded side branches capable of attenuating a plurality of sound waves produced by the exhaust gases of an internal combustion engine.

It is another object of the invention to provide a compact muffler of the side branch type capable of attenuating sound waves having a low frequency.

Still another object of the invention is to provide a muffler which has an arrangement of sound passages and sound paths resulting therefrom which are relatively free of obstructions to avoid otherwise developing numerous reflecting waves at frequencies which could potentially interfere with the dampening or attenuation of desired waves.

It is another object of the invention to provide a muffler which has in its design, the ability to be tuned to produce any desired sound and particularly a sound associated with high performance automobiles and/or sports cars.

Yet another object of the invention is to provide a muffler which can be readily tuned to isolate and eliminate exhaust gas noises producing objectionable noises attributable to resonance frequencies occurring within the cabin or passenger compartment of an automotive vehicle.

Still another object of the invention is to produce a short side branch muffler capable of attenuating low frequency noise.

Another object of the invention is to produce a side branch muffler capable of attenuating a relatively large plurality of sounds produced by the exhaust gases of an internal combustion engine over a relatively wide range of sound wave frequencies.

Yet another object of the invention is to provide a muffler having not only the characteristics as described but in addition having a straight through exhaust design producing little back pressure which would otherwise adversely affect the performance of the engine.

Yet another object of the invention is the provision of a straight through muffler in which an outer casing functioning to form a chamber for a sound reflection arrangement also functions as the muffler housing otherwise required in side branch muffler designs minimizing the cost of the muffler.

Still another object of the invention is to provide a sound attenuation arrangement which can be applied to any type of muffler design for attenuating noise of a set frequency or range of frequencies.

Still another object of the invention is to provide a muffler which can be easily assembled in a wide variety of configurations and is relatively inexpensive.

These and other objects, features and advantages of the invention will become apparent to those skilled in the art upon a reading of the Detailed Description of the invention set forth below taken together with the drawings which be described in the next section.

BRIEF DESCRIPTION OF THE DRAWINGS

The invention may take physical form in certain parts and arrangement of parts, a referred embodiment of which will be described in detail and illustrated in the accompanying drawings which form a part hereof and wherein.

DETAILED DESCRIPTION OF THE INVENTION

Figure 1:
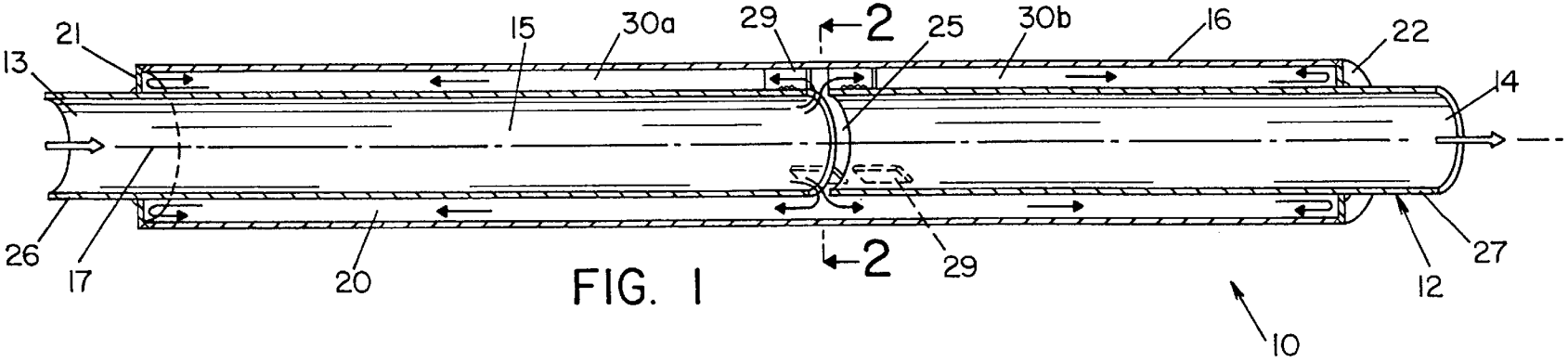
FIG. 1 is an axially sectioned, perspective view of a muffler incorporating the invention in one of its simplest forms.
Figure 2:
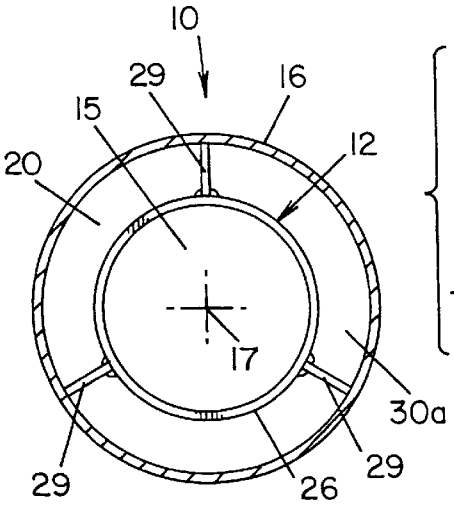
FIG. 2 is a cross-section view of the muffler of FIG. 1 taken along lines 2—2 of FIG. 1.

Referring now to the drawings wherein the showings are for the purpose of illustrating a preferred and alternative embodiments of the invention only and not for the purpose of limiting same, there is shown in FIGS. 1 and 2 a muffler 10 illustrating the basic concepts employed in the present invention.

Muffler 10 has an inner, axially extending tubular casing 12 which is shown as cylindrical in all embodiments extending from an inlet 13 to an outlet 14. Inner casing 12 defines an open ended inner tubular (shown as cylindrical in all the embodiments) chamber 15 encompassed thereby through which exhaust gases from an internal combustion engine flow from inlet 13 to outlet 14 as shown by the arrows in FIG. 1. Circumscribing inner casing 12 is an outer, axially extending tubular casing 16 spaced radially outwardly from inner casing 12. In all the embodiments shown outer casing 16 is cylindrical and concentric with inner casing 12 about axially extending centerline 17. While a cylindrical arrangement is preferred, it is not absolutely necessary for a working of the invention. Oval or elliptical tubular configurations will also work. Outer casing 16 and inner casing 12 define an axially extending outer annular chamber 20 therebetween. Outer casing 16 includes an inlet end wall section 21 adjacent inlet 13 and an outlet end wall section 22 adjacent outlet 14 radially extending and affixed to inner casing 12 so that outer chamber 20 is closed ended. In the drawings, muffler 10 is shown as a fabrication and end wall sections 21 and 22 are shown as annular plates welded to outer and inner casings 16, 12 to close outer chamber 20. Either configuration is acceptable.

Generally mufflers include a housing which is not shown in FIG. 1 or in the other drawings. A housing indicated by dot-dash line 24 is optionally shown in FIG. 12 and the housing generally fixes the position of inlet 13 and outlet 14 while functioning as support for the brackets and the like, if needed, for securing muffler 10 within the vehicle's exhaust system. It is possible with muffler 10 to do away with the housing per se as a separate piece of sheet metal containing inner and outer casings 12, 16 because of end wall sections 21, 22. In such instance, outer casing 16 will have a gauge sufficiently thick to function as housing 24 as well as outer casing 16. Thus reference to the term "housing" as used in this patent and in the claims means either outer casing 16 or a separate housing 24 encompassing outer casing 16.

Fluid communication between inner chamber 15 and outer chamber 20 is through a slot arrangement which forms an annular slot 25 having a set axial length circumscribing inner casing 12. The slot arrangement is formed by constructing inner casing 12 as two separate cylindrical sections. An inlet inner casing section 26 is affixed by weldment to inlet end wall 21 and an outlet inner casing section 27 is affixed by welding to outlet end wall 22. Inlet inner casing section 26 has an end confronting and axially spaced from a confronting end on outlet inner casing section 27. The axially spaced distance defines annular slot 25. It is somewhat important to note that slot 25 is not in the nature of a perforation or an opening in a tube for reasons which will be discussed further below. In order to support inlet and outlet inner casing sections 26, 27 radial spacers 29 extending from outer casing 16 to inner casing 12 are provided. Radial spacers 29 are preferably arranged equally about the circumference of inner and outer casings 12, 16, typically at angles of 120°. In muffler 10 of FIGS. 1 and 2 a total of six spacers are utilized. It should also be noted that for ease in discussing the invention, the term "inner casing" is used to describe two separate cylinders which are referred to as casing "sections" 26, 27.

Within outer chamber 20 is a sound attenuating mechanism which takes the form of a sound attenuating, axially extending, annular passage 30 formed in outer chamber 20. In muffler 10 shown in FIGS. 1 and 2, there is a sound passage 30*a* extending on one side of slot 25 and a second sound passage 30*b* formed on the other side of slot 25. The axial distance of sound passage 30*a* is different than the axial distance of sound passage 30*b*. Sound passages 30*a*, 30*b* are folded side branches.

The basic concepts forming the underpinning of the invention can now be explained with reference to the configuration of muffler 10 as described for FIGS. 1 and 2. Exhaust gases from the internal combustion engine are exhausted as pulses of gas under pressure determined by the engine's timing controlling the opening and closing of intake and exhaust valves. As noted in the Background, the pressure pulse produced by the gases exhausted through the exhaust valves carries a wave front which travels through the exhaust system and dissipates in three dimensional expansion. Whenever an obstruction is encountered by the pulse wave, sound waves having a frequency spectrum or a wide range of frequencies will be emitted. When the exhaust gases travel through inner chamber 15, they will encounter slot 25 and pressurize sound passages 30*a*, 30*b* which are closed end because of inlet and outlet end wall sections 21, 22. Slot 25 is an obstruction and sound waves will travel through slot 25, into sound passages 30*a*, 30*b* and will contact end wall sections 21, 22 where they will reverse in direction and travel and then exit sound passages 30*a*, 30*b*.

Figure 3:
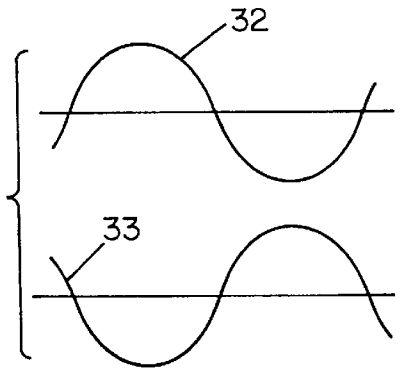
FIG. 3 is a diagrammatic representation of attenuation of a sound wave by the reflection thereof.
Figure 4:
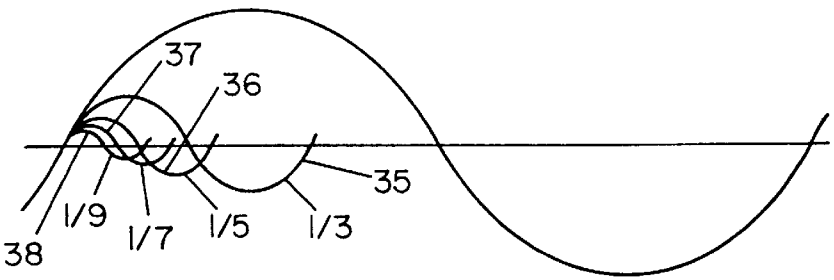
FIG. 4 is a diagrammatic representation of the harmonics of a sound wave.

Referring now to FIG. 3 the sinusoidal form of a sound wave traveling in space is depicted by a curve designated as 32. As is well known the frequency or period of the sinusoidal sound curve is a function of the emitted sound. High pitched sounds have waves with short frequencies and low pitched sounds have long periods or frequencies. Low pitched exhaust sounds are typically those which are objectionable. When the sound wave travels through a sound passage 30 and strikes an end wall section 21 or 22, i.e., a sound reversal wall, it is reversed. More specifically, and for consistent terminology, the sound wave travels a sound path which extends from inner chamber 15 through a sound passage 30 to a reflecting wall and back. If the axial length of the sound passage 30 or sound path length is matched to the period of a given sound wave (i.e., period times speed equals distance) it becomes possible to produce a reflected sound wave which has its period shifted 180° as shown by a matched reflected sound wave 33 in FIG. 3. Reflected sound wave 33 thus cancels out or attenuates or dampens incoming sound wave 32. FIG. 4 is drawn to illustrate the presence of harmonics in sound wave 32. Assuming that sound wave 32 was perfectly attenuated by reflected wave 33, 3rd order harmonic waves indicated by reference numeral 35, 5th order harmonic waves indicated by reference numeral 36, 7th order harmonic waves indicated by reference numeral 37 and 9th order harmonic waves indicated by reference numeral 38 would still be present. Because of the presence of harmonics, the reflecting wave can never totally cancel or mute the incoming sound wave. However the largest order of sound magnitude can be canceled. This invention does not address the harmonic waves. Generally speaking, and as shown in FIG. 4 the energy or amplitude of such waves are less then the attenuated sound waves and the noise is reduced. It is also appreciated that whenever the sound wave strikes an object it is reflected and if the sound wave strikes many objects in the sound path many sound wave reflections will be produced which can interfere with the attenuation of a specific sound wave.

Figure 5:
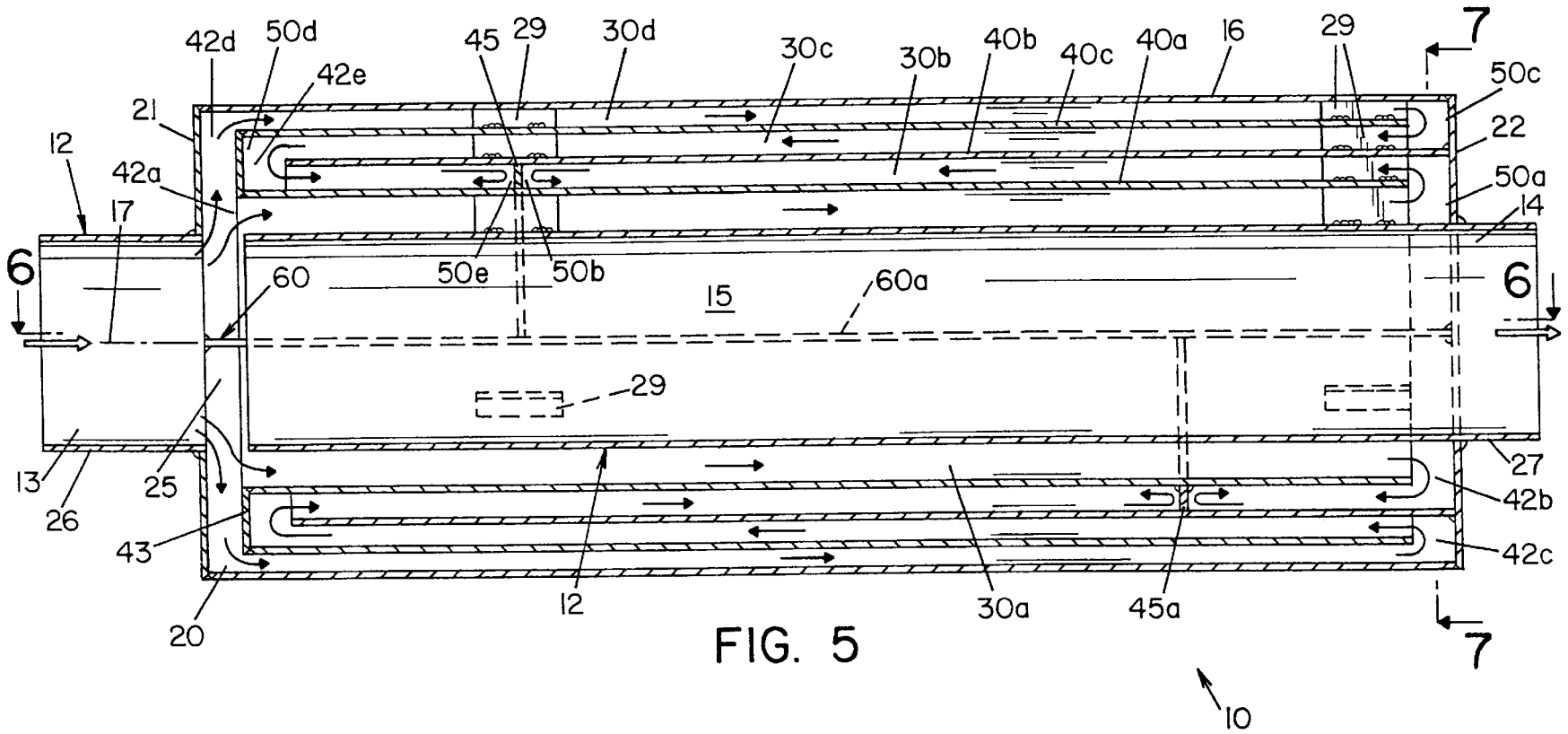
FIG. 5 is an axially extending, sectioned view of a preferred embodiment of the muffler of the invention.
Figure 6:
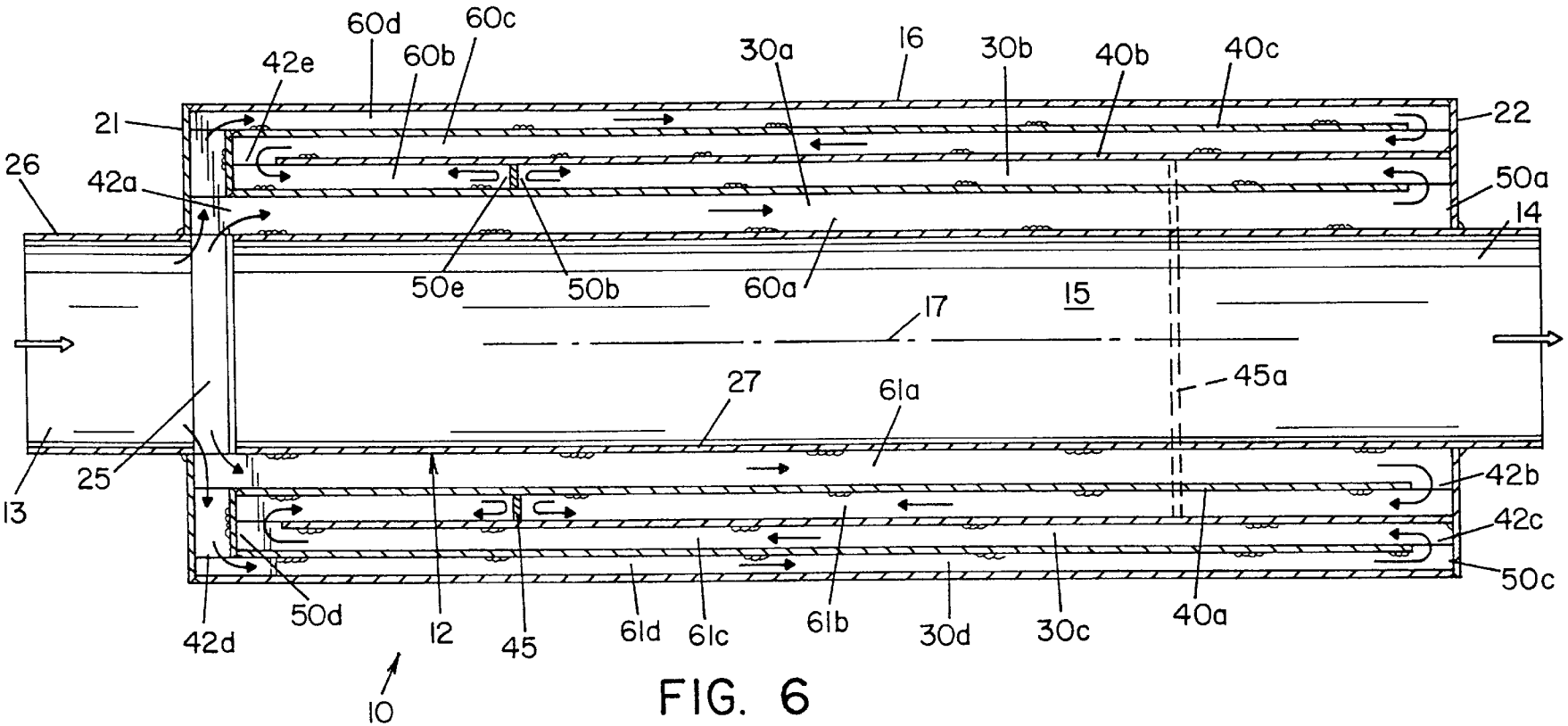
FIG. 6 is an axially extending section view of the muffler of FIG. 5 taken along lines 6—6 of FIG. 5.

The discussion above covering dampening of sound waves by reflection is conventional and forms the basis for side branch mufflers. While muffler 10 of FIG. 1 only has provision for dampening waves of two different frequencies, it nevertheless does illustrate certain characteristics of the present invention which are used in the various embodiments of the invention discussed below. First, the side branches are folded over. In fact the side branches are folded parallel to inner casing 12 establishing the basis for a compact design. Second, in order for the pressure of the pulses and/or the energy of the sound waves to be dissipated the axial spacing of slot 25 has to be at least as long as the radial distance of slotted passage 30. This relationship has been uncovered through trial and error. Simply providing openings or perforations in the form of a series of aligned openings do not produce consistent results or results as good as that obtained with the configuration described. It is believed this results because openings, such as those used in prior art side branch mufflers, have edges defining the openings which in themselves act as obstructions to the wave front. The obstructions are reduced to a minimum vis-a-vis slot 25 and the axial spacing thereof Referring now to FIGS. 5, 6, 7 and 8, there is shown the preferred embodiment of muffler 10 and reference numerals used for explaining the components of muffler 10 shown in FIGS. 1 and 2 will likewise be used in describing the same components of muffler 10 shown in FIGS. 5–8. As best shown in FIGS. 5 and 6 inlet inner casing section 26 and outlet inner casing section 27 are formed differently than that shown for muffler 10 in FIGS. 1 and 2 so that annular slot 25 is positioned at one end (i.e., the inlet end) of inner casing 12 to produce the longest sound passages 30. The sound attenuating arrangement additionally includes a plurality of generally cylindrical, concentric intermediate casings 40 radially spaced from one another within outer chamber 20. There are three intermediate casings shown in FIGS. 5–8 which are designated 40*a,* 40*b* and 40*c*. The annular axially extending space between adjacent casings 12,16 and 40 defines a sound attenuating passage 30. Specifically the annular space between inner casing 12 and first intermediate casing 40*a* defines first sound passage 30*a;* the space between first and second intermediate casings 40*a,* 40*b* defines second sound passage 30*b;* the space between second and third intermediate casings 40*b,* 40*c* defines third sound passage 30*c;* and the space between third intermediate casing 40*c* and outer casing 16 defines fourth sound passage 30*d.* Any number of intermediate casings 40 can be used provided the radial space therebetween is sufficient to permit transmission of the energy of the sound waves.

Each sound passage 30 must have an entrance 42 and the axially spacing of the entrance end should be at least as long as the radial distance of the sound passage 30 or, alternatively stated, at least as long as the radial distance between adjacent casings 12, 40, 16. Entrances 42 for sound passages 30*a,* 30*b,* 30*c* and 30*d* are shown, respectively as 42*a,* 42*b,* 42*c,* 42*d.* In addition, for this embodiment, there is a back entrance 42*e* for sound passage 30*b.* At the opposite end of each sound passage is a reflecting wall which can be either end wall section 21 or 22, an annular passage end plate 43 or a stop plate 45 whereat the wave is reflected. Thus, each sound passage produces a reflecting wave for attenuation. Sound passages 30 are arranged so that entrances 42 are either adjacent slot 25 or adjacent an adjacent sound passage 30 and a variety of various configurations are illustrated in the drawings. When entrance 42 of one sound passage communicates with a radially adjacent sound passage two sound paths are established, namely a first sound path extending the axial length of the first sound passage and a second sound path extending the axial length of the first sound passage and the axial length of the second sound passage. By arranging entrances 42, a variety of sound paths of various lengths can be established to attenuate any sound wave of a given frequency. As discussed with reference to muffler 10 shown in FIGS. 1 and 2, sizing the axial distances of entrances 42 is necessary to assure transmission of sound wave energy. Also the volume of each sound passage 30 not only has to be maintained at a sufficient size to permit wave energy transmission but also should be maintained consistent with one another to avoid undue pressure undulations which could adversely affect the sound waves when the second waves travel a sound path extending along two or more sound passages 30. Because each sound passage 30 circumferentially extends about inner casing 12 in a concentric relationship the average diameter of each sound passage 30 has to successively increase as the passage are spaced radially outwardly. The radial distance of each sound passage 30 has to successively diminish for each radially outward positioned sound passage 30. Thus the radial distance of sound passage 30*a* is larger than the radial distance of sound passage 30*b* which in turn is larger than the radial distance of sound passage 30*c* which in turn is larger than the radial distance of sound passage 30*d.*

It is possible to provide a multiplicity of sound reflecting paths which exceed the number of sound passages 30 and this is accomplished in muffler 10 illustrated in FIGS. 5–8 by fixing every other casing or alternating the fixing of every other radially spaced casing to an outer casing end wall section 21 and/or 22. Thus inner casing 12, intermediate casing 40*b* and outer casing 16 is fixed to outlet end wall section 22. Intermediate casings which are not fixed to an end wall section, namely intermediate casings 40*a* and 40*c,* are positioned radially by means of support spacers 29, have entrances 42*b,* 42*c* spaced from outlet end wall section 22 and are closed at their axial ends opposite their entrances by annular passage end plate 43. The sound attenuation arrangement includes for a given sound passage the positioning of an annular stop plate such as stop plate 45 shown in the upper portion of muffler 10 in FIGS. 5 and 6 which extends the radial distance of sound passage i.e., sound passage 30*b.* Stop plate 45 bifurcates or divides a sound passage 30 to produce an additional sound reflecting path 50. Specifically for muffler 10 shown in FIGS. 5–8 there are four sound passages 30 producing five sound paths 50 as illustrated by the arrows shown in the drawings.

Referring to the top portion of FIG. 5, a sound wave travels a first sound path from slot 25 through first passage entrance 42*a* and along the axial distance of first sound passage 30*a* until it strikes outlet end wall section 22 whereat it is reflected and this first path is indicated by a point designated by the reference numeral 50*a.* A sound wave travels a second sound path from slot 25 through first passage entrance 42*a,* along the axial distance of first sound passage 30*a,* through second passage entrance 42*b* and along the length of second passage 30*b* until it strikes stop plate 45 whereat it is reflected and this second path is indicated by a point designated by the reference numeral 50*b.* A sound wave travels a third sound path from slot 25 through fourth passage entrance 42*d* and along fourth sound passage 30*d* until it strikes outlet end wall section 22 whereat it is reflected and this third sound path is indicated by a point designated by the reference numeral 50*c.* A sound wave travels a fourth sound path from slot 25 through fourth passage entrance 42*d,* along fourth sound passage 30*d,* through third passage entrance 42*c* and along third sound passage 30*c* until it strikes passage end plate 43 whereat it is reflected and this fourth sound path is indicated by a point designated by the reference numeral 50*d.* Finally a sound wave travels a fifth sound path from slot 25 through fourth passage entrance 42*d,* along fourth sound passage 30*d,* through third passage entrance 42*c,* along the length of third sound passage 30*c* and then through back entrance 42*e* and along second sound passage 30*b* until contacting stop plate 45 whereat the wave is reflected and this fifth sound path is indicated by a point designated by the reference numeral 50*e.* Also it should be noted that a short attenuation sound path exists from slot 25 to outer casing 16. Each of the sound attenuation paths have different lengths and attenuate sound waves of different frequencies. Any number of sound paths can be established. However, there are not a large number of sound paths within any given combination of connected sound passages 30 (preferably no more than three) so that a large number of potentially conflicting reversed wave fronts do not exist.

The sound paths 50 illustrated for the drawing top portion of muffler 10 shown in FIGS. 5–8 are typical of various folded side branches which can be constructed in accordance with the invention. Other sound passage 30 configurations for producing various lengths of sound paths 50 vis-a-vis the axial position of stop plate 45 will suggest themselves to those skilled in the art. One of the underpinnings of the invention is the recognition that a side branch can be constructed to be folded over to extend parallel to the length of a straight through muffler provided that certain dimensional relationships are maintained. Those relationships include first providing a sufficient volume for the sound passage 30 to transmit the energy of the sound wave. That is the sound wave must travel unimpeded through the passage to generate a reflection wave that in turn can travel back through sound passage 30 to cancel out the sound wave. Once the volume is established the entrances for the waves to travel from inner casing 12 into sound passages 30 cannot unduly restrict the pressure pulse nor provide obstructions in the wave path. In the embodiments discussed, this restriction is met by the configuration of slot 25 and entrances 42 expressed in terms of the radial distances of the sound passages 30. More precise mathematical formulas can be developed to express the relationship but those formulas will use, as an important factor, the radial distance of sound passage 30. Finally, because of the serpentine nature of sound paths 50, the volume of sound passages 30 should remain relatively constant with respect to one another. This is accomplished by varying the radial distance of sound passages 30 so that the mean diameter of successively larger diameter sound passages 30 is reduced.

Figure 16:
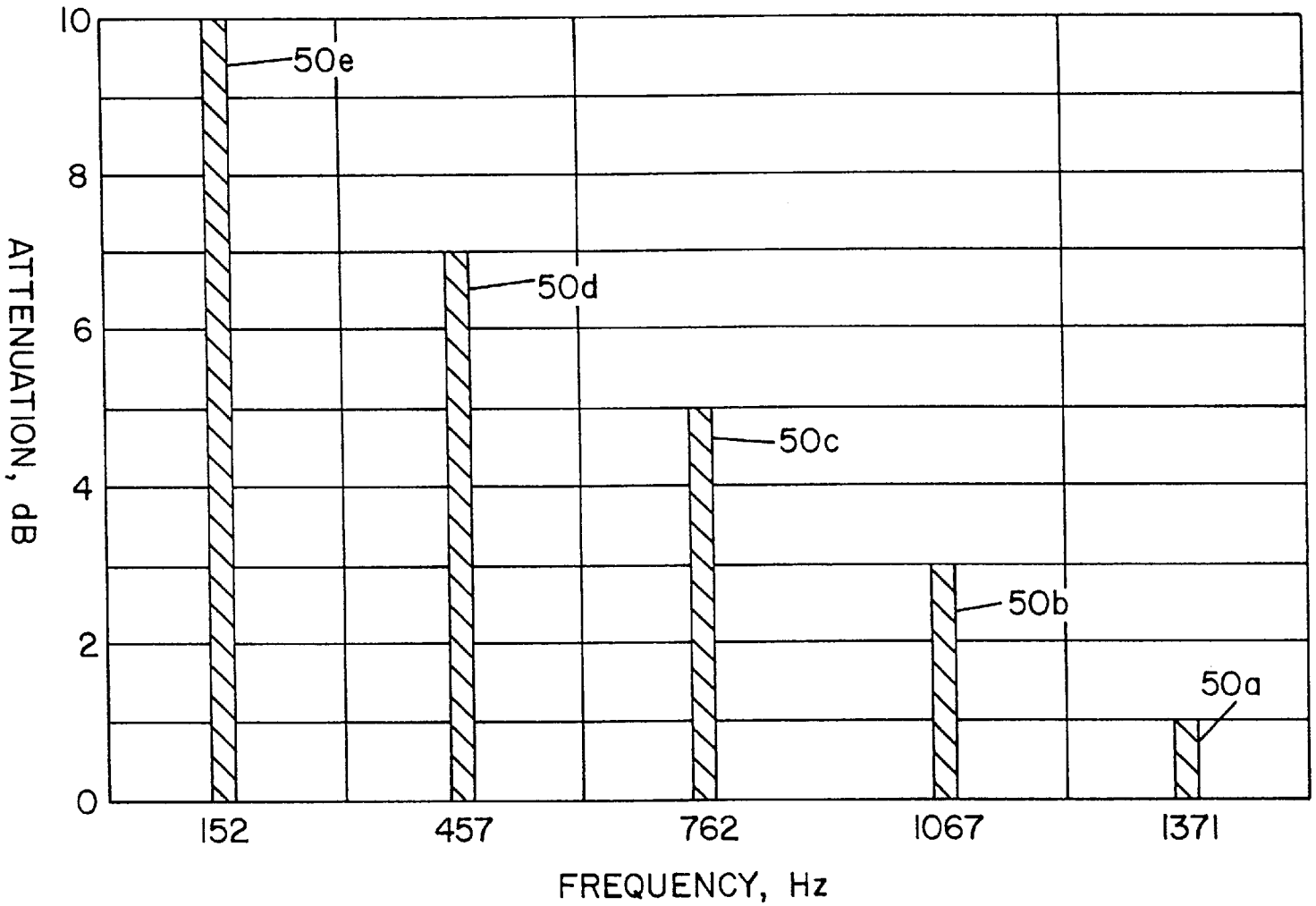

By way of example, a muffler 10 of the configuration typified in FIGS. 5–8 was developed for a high performance automobile, specifically, a Corvette. The diameter of inner casing 12 was set at 2.5", the diameter of a high performance exhaust pipe. The axial distance of muffler 10 from inlet 13 to outlet 14 was approximately 14.5", a dimension which would be considered small for resonators used in combination with mufflers on other vehicles. The diameter of outer casing 16 was set at approximately 5.5". The radial distance of sound passages 30 progressively varied from the first innermost sound passage 30*a* of about 0.5" to the outermost fourth sound passage 30*d* of about 0.3". The axial distance of annular slot 25 and the axial distance of entrances 42 was set at about 0.5" (although this distance can be extended to as high as about 1"). With this configuration of a muffler constructed in accordance with the embodiment illustrated in FIGS. 5–8, a sound attenuation for the five sound paths 50*a*–50*e* described above is illustrated in the graph depicted in FIG. 16. In FIG. 16 the length of the five sound paths 50 are converted into the wave frequency of a sound wave which is attenuated by a reflecting wave developed in sound passage(s) 30 for that sound path and is shown on the horizontal axis. The decibel reduction in sound is shown on the vertical axis. Significantly, large decibel sound reductions for low frequency waves are now possible.

The muffler designer can now specifically tune muffler 10 for any application while maintaining the advantages of a straight through exhaust design. That is, one of the distinguishing features of the muffler of the invention is that sound paths 50 are separately identifiable from one another. Other muffler designs incorporate complex chambers and baffles. Dimensionally changing one baffle causes a "pyramid" effect resulting in different sound changes occurring in the other baffles. Inherent in this invention is that sound paths 50 are separate from one another and identifiable. It now becomes possible to change any one sound path to tune or cancel out any specific wave without adversely affecting the other attenuations. As indicated in the Background discussion above, the rigid unibody designs now being developed for performance vehicles promote resonance frequencies in the cabin at various operating speeds of the engine. The only practical manner to address this problem is to identify the objectionable sound wave frequency and then tune the muffler design for that vehicle by positioning stop plate 45 in a sound passage 30 at a distance which can attenuate the objectionable sound wave. The invention makes this possible. Prior art mufflers could only resolve the problem by haphazard trial and error approaches which could remove one objectionable noise and replace it with another.

Figure 14:
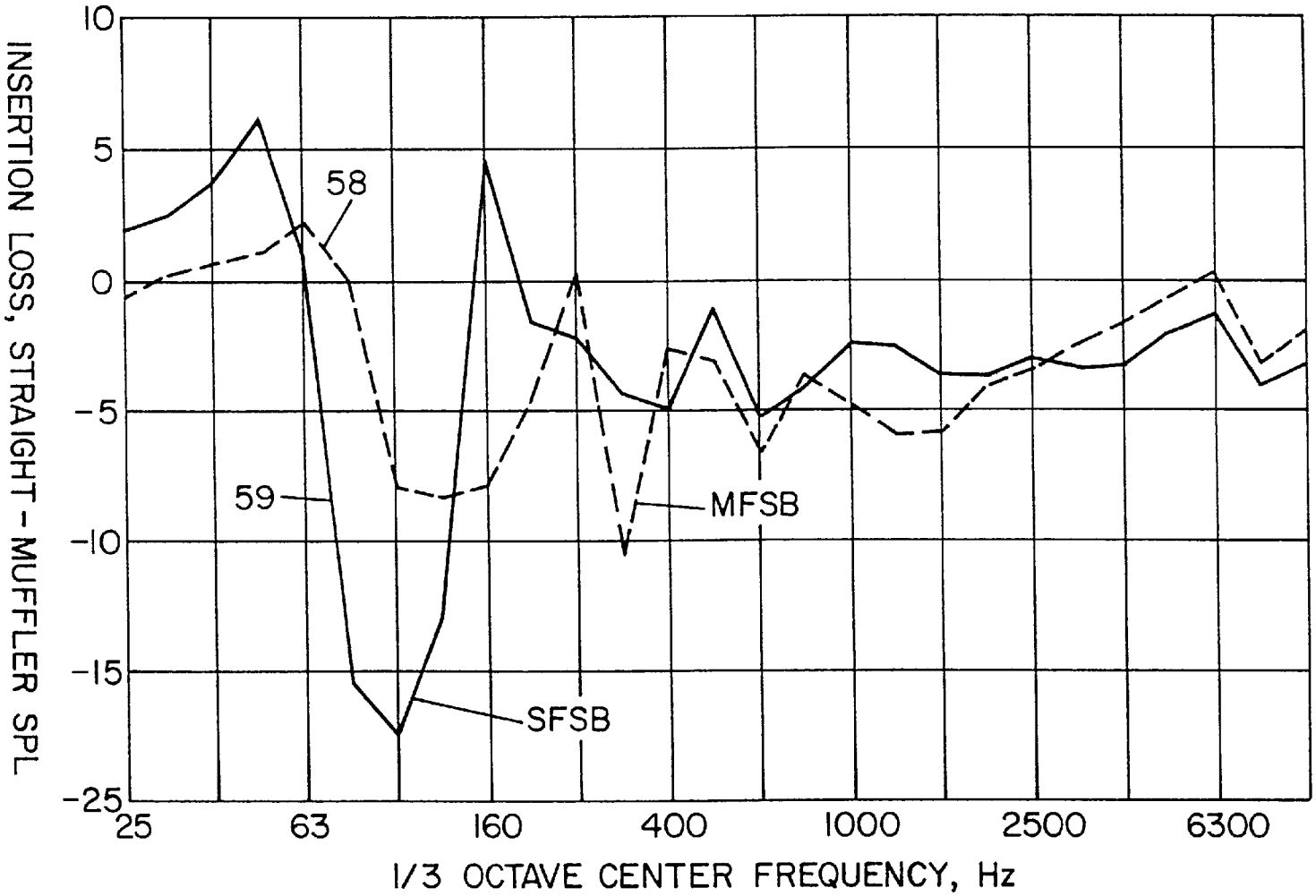
FIG. 14 is a graph showing the insertion loss in decibels plotted on the y-y axis for various sound wave frequencies plotted on the x-x axis for the inventive muffler compared to the performance of a conventional single fold side branch muffler.

This characteristic of the invention can be somewhat shown by reference to the graph set forth in FIG. 14. FIG. 14 shows an insertion loss on the vertical axis for sound waves of various frequencies (plotted at ⅓ Octave center frequency in Hz) on the horizontal axis for a muffler constructed in accordance with the invention shown by dashed line 58 and a conventional single folded side branch muffler shown by solid line 59. The insertion loss shown on the y-y axis is the variation in sound (for the plotted wave frequencies) produced by a muffler when compared to the variation in sound (for the plotted wave frequencies) produced by a straight exhaust pipe (no muffler present). Ideally the muffler would have a straight horizontal line over a set range of wave frequencies indicating an ability to totally tune out objectionable sounds. This is not practically possible for any number of reasons, including harmonics as discussed above. FIG. 14 shows that the muffler of the present invention attenuates the sound over a wider range of wave frequencies than a conventional side branch muffler. It is thus possible to better tune the muffler of the invention when compared to conventional side branch mufflers. As noted in the Background, side branch mufflers are generally preferred over other types of sound dampening arrangements because of their ability to dampen specific sound waves. The objection to side branch mufflers, which was a valid objection until this invention, is the space required by such muffler. FIG. 14 shows that the multi-folded side branch arrangement disclosed herein has a better ability to dampen sound waves than conventional side branch mufflers.

Figure 7:
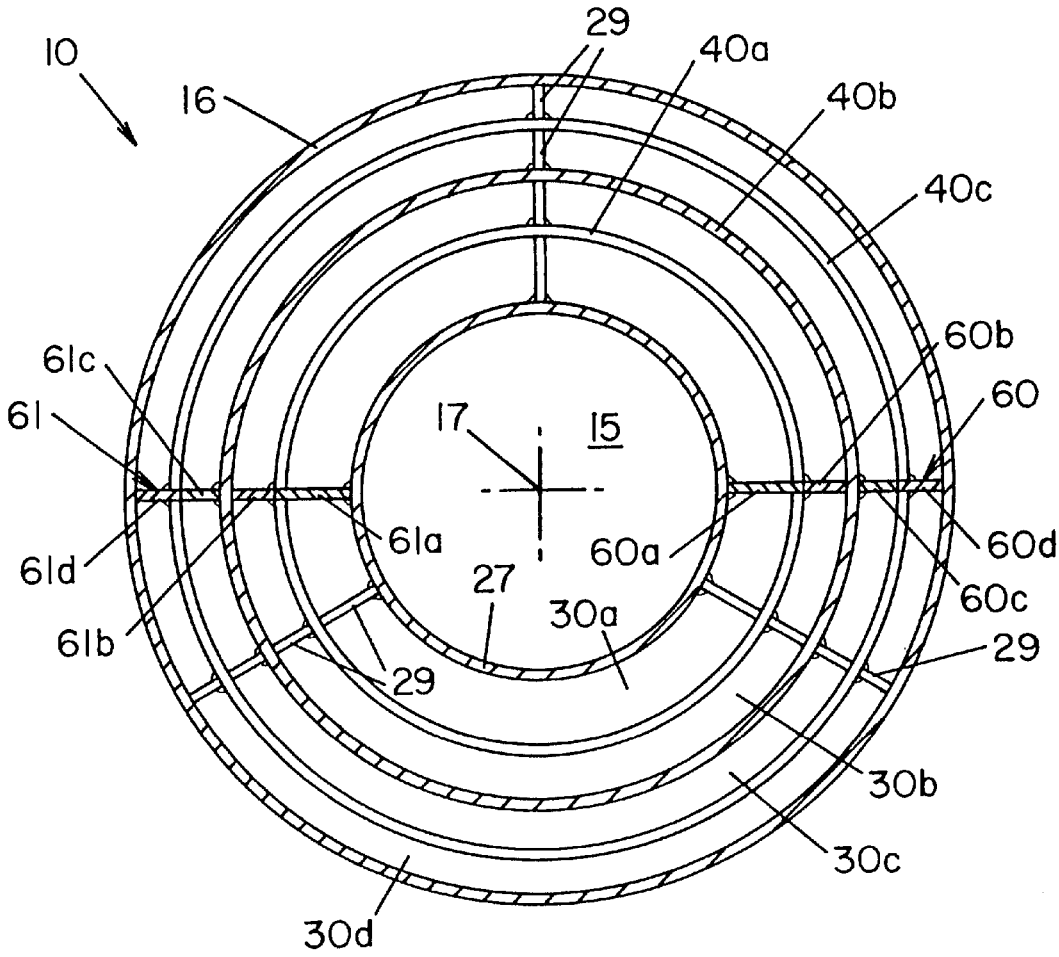
FIG. 7 is a cross-sectioned view of the muffler of FIG. 5 taken along lines 7—7 of FIG. 5.

An important concept of the invention is that a relatively large plurality of side branches can be incorporated into muffler 10 without unduly increasing its diametrical size. Referring still to FIGS. 5–8, a divider plate 60 extends axially from inlet end wall section 21 to outlet end wall section 22 and radially from inner casing 12 to outer casing 16. As best shown in FIG. 7, divider plate 60 actually is comprised of a series of equal length divider plate segments shown as first segment 60*a* radially extending from inner casing 12 to first intermediate casing 40*a,* second segment 60*b* radially extending from first intermediate casing 40*a* to second intermediate casing 40*b;* third segment 60*c* radially extending from second intermediate casing 40*b* to third intermediate casing 40*c* and fourth segment 60*d* radially extending from third intermediate casing 40*c* to outer casing 16. Divider segments are welded to casings 12, 16 and 40 to increase rigidity of muffler 10. As best shown in FIG. 7, diametrically opposite divider plate 60 is a second divider plate 61. It likewise is constructed of second divider plate segments 61*a,* 61*b,* 61*c* and 61*d*. Divider plates 60, 61 transform muffler 10 shown in FIGS. 5–8 and as thus far described into two mufflers. One muffler configuration is shown at the top portion of FIGS. 5 and 7 above divider plates 60, 61 and the other muffler configuration is shown at the lower portion of FIGS. 5 and 7 below divider plates 60, 61. It should be clear that muffler 10 as previously described can function without divider plates 60, 61. In that case, annular sound passages 30 would completely circumscribe inner and outer casings 12, 16.

Figure 8:
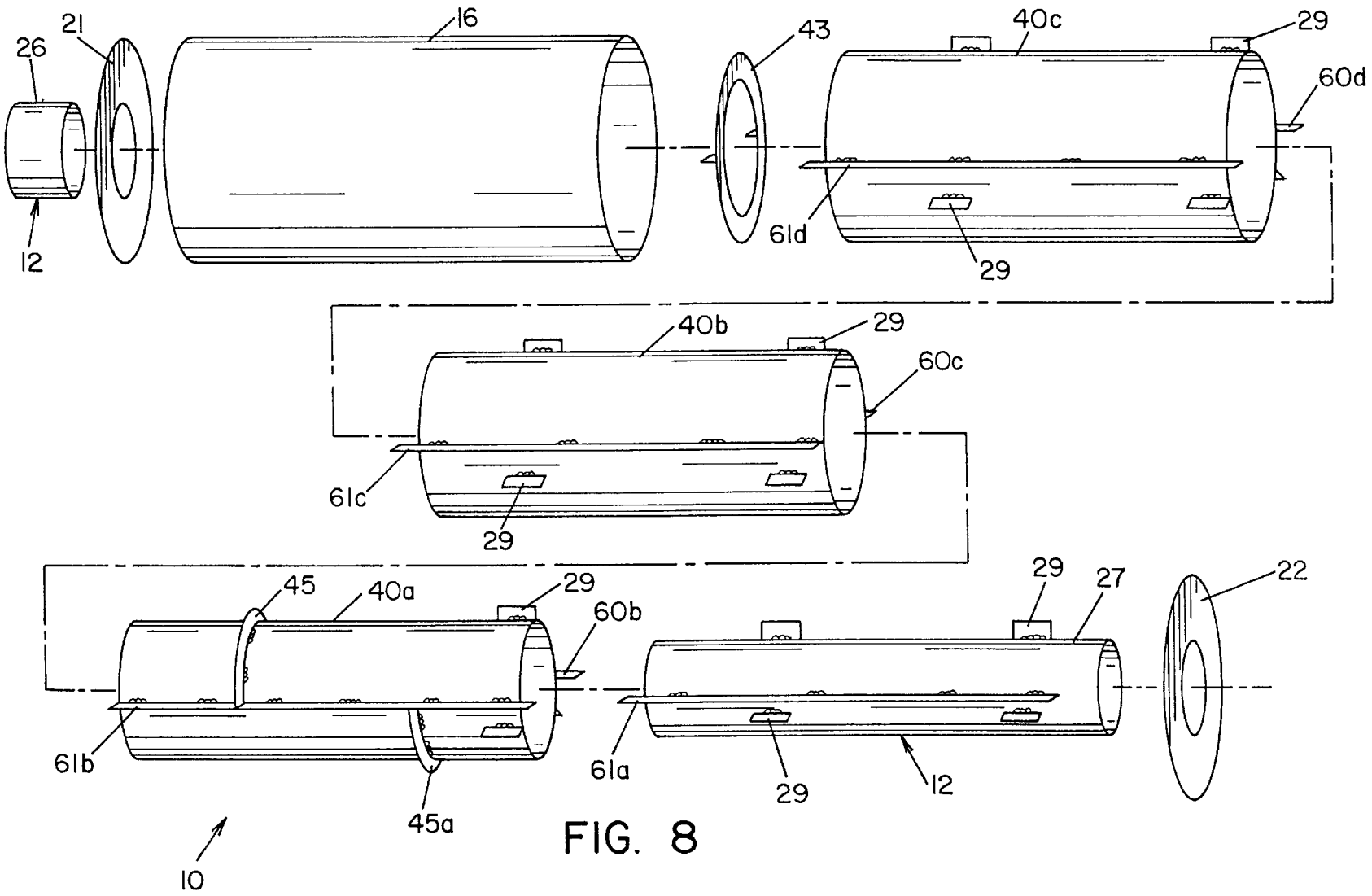
FIG. 8 is an exploded, perspective assembly view of the muffler of FIG. 5.

By dividing sound passages 30 into two pluralities vis-a-vis divider plates 60, 61 it is now possible to insert an additional stop plate(s) 45*a* in a sound chamber 30 below divider plates 60, 61. As best shown in FIGS. 5 and 8, a second stop plate 45*a* is inserted in sound passage 30*b* but at a different axial position than that whereat stop plate 45 was inserted. The path lengths previously described as the second path length 50*b* and the fifth path length 50*e* for sound passages 30 above divider plates 60, 61 is different than the second and fifth path lengths 50*b,* 50*e* for sound passages 30 below divider plates 60, 61.

Divider plates 60, 61 make it possible to circumferentially split annular sound passages 30 into two like pluralities of sound passages thus increasing the number of wave frequencies muffler 10 can attenuate without increasing the diameter of outer casing 16. In theory any number of divider plates can be utilized and there is no requirement that sound passages 30 be divided into equal arcuate segments. However, as discussed above, the volume of each sound passage 30 must be sufficient to transmit the energy of the sound waves. As a practical matter this requirement limits the number of divider plates which can be inserted into the muffler. It is believed, for the muffler size discussed above, that a maximum number of six divider plates could be incorporated into the muffler design preferably spaced at 60° arcuate increments and producing six equal pluralities of sound wave passages 30.

Figure 9:
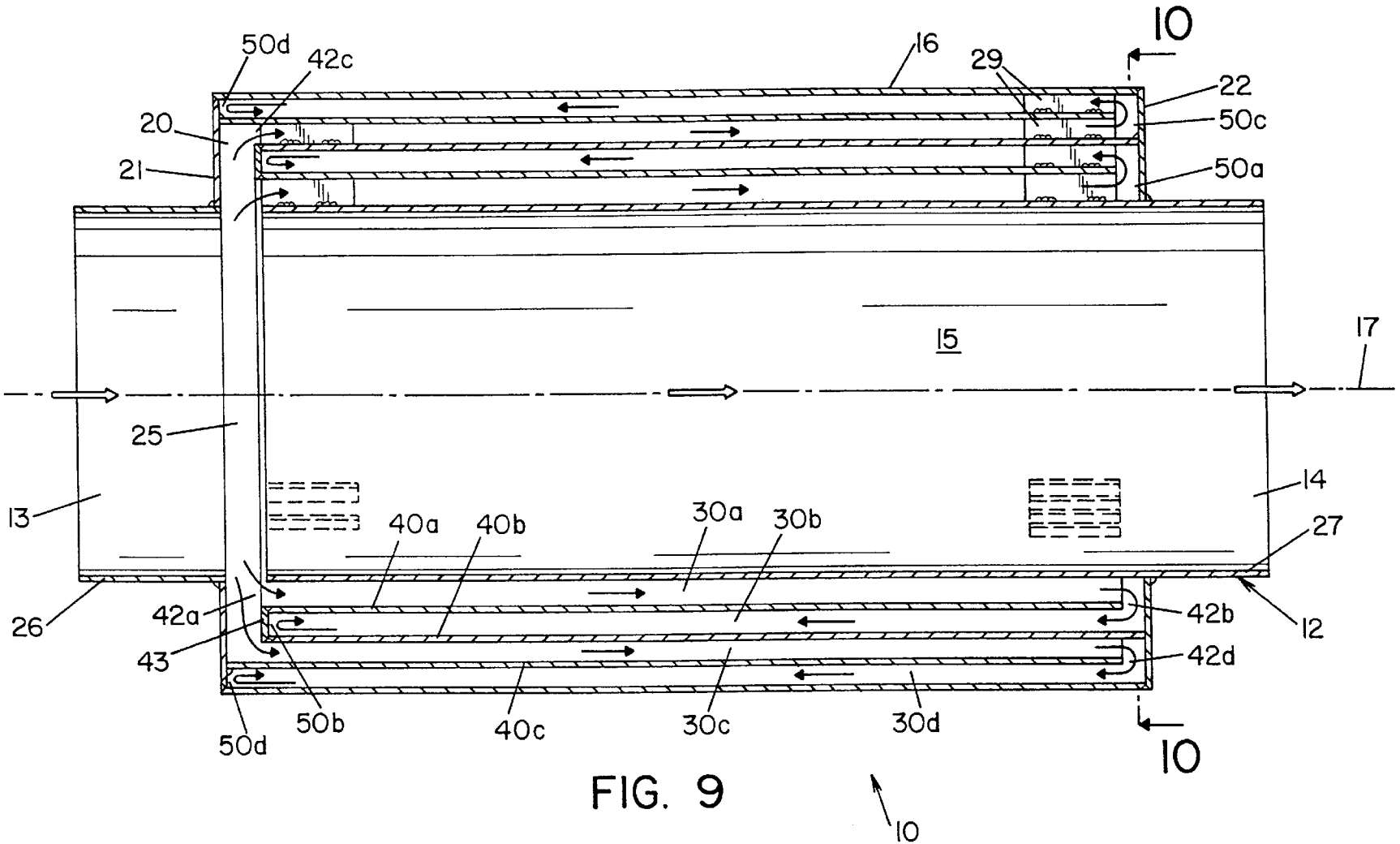
FIG. 9 is an axially section view of an alternative embodiment of the inventive muffler similar to that of FIG. 5.
Figure 10:
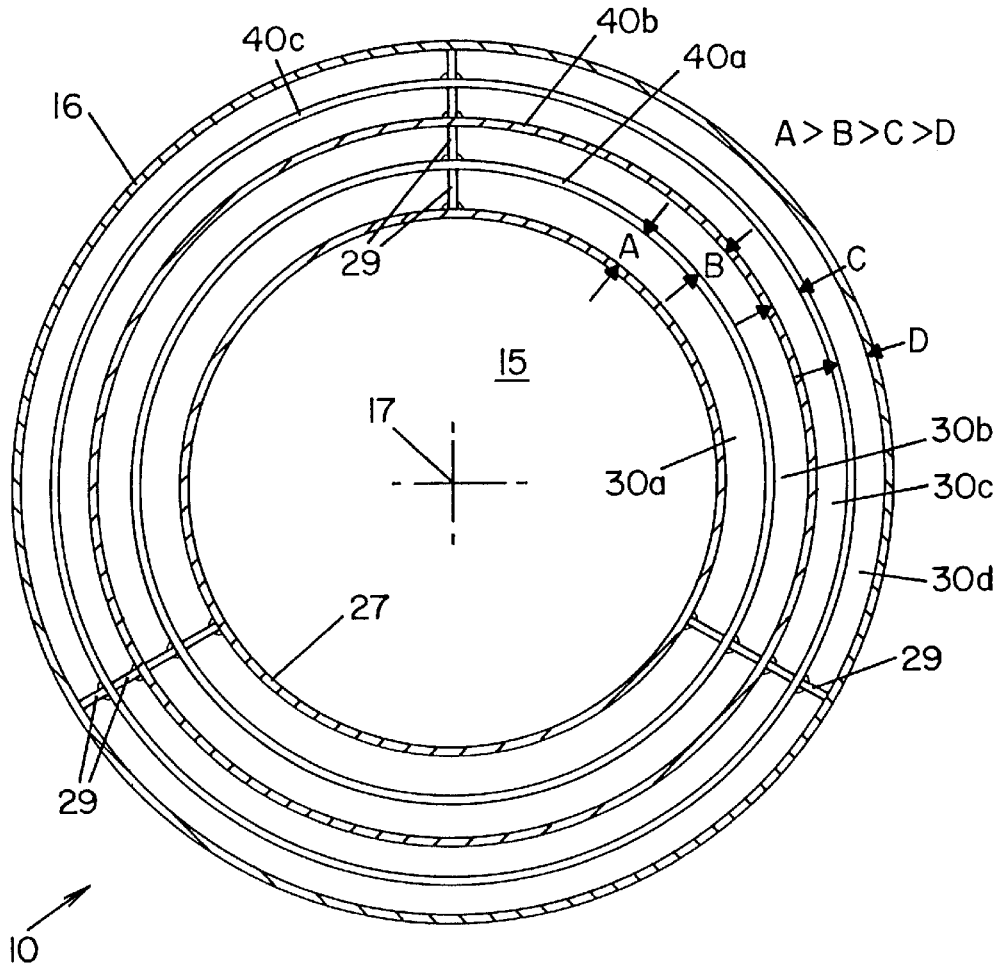
FIG. 10 is a cross-sectioned view of the muffler of FIG. 9 taken along lines 10—10 of FIG. 9.
Figure 11:
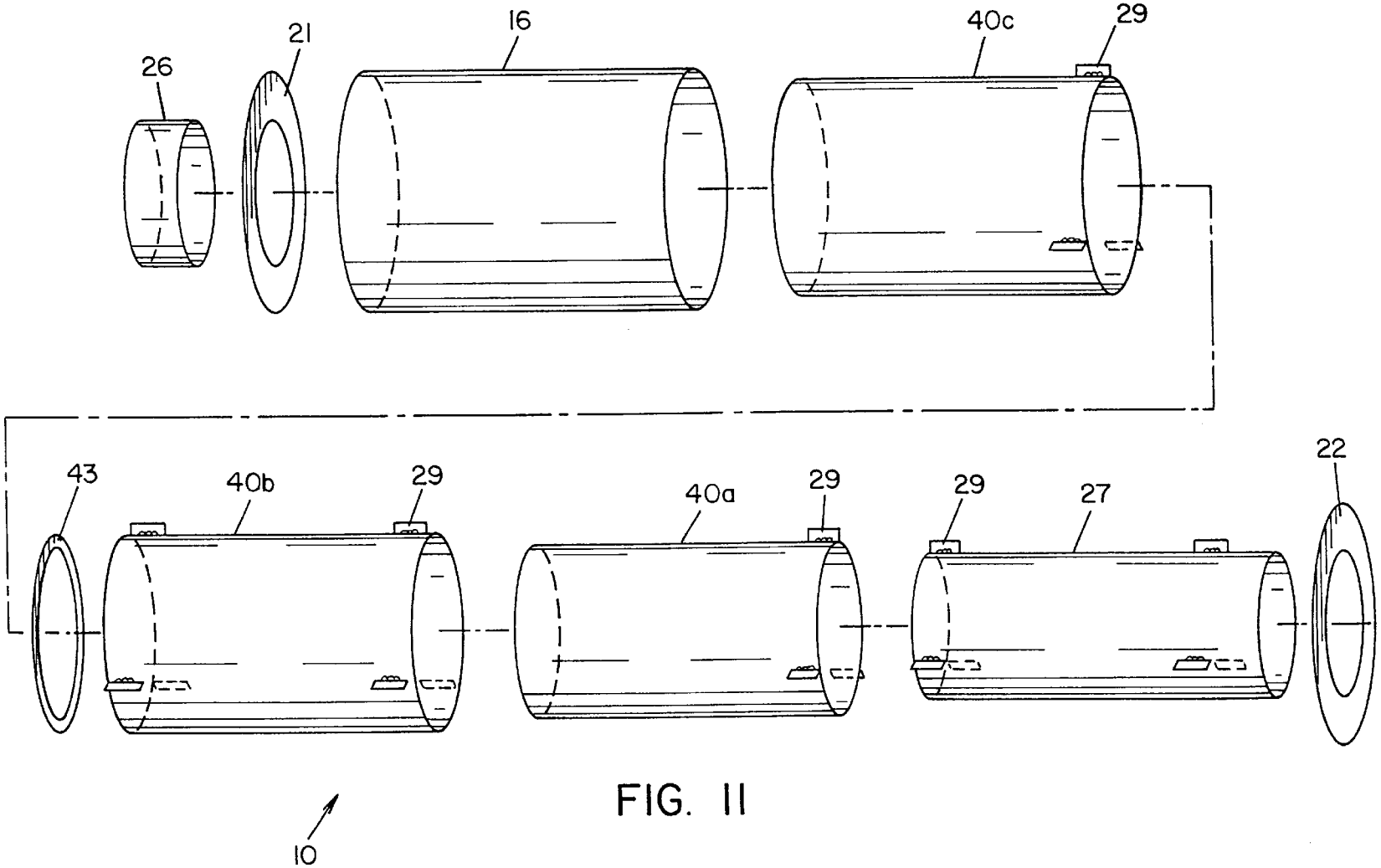
FIG. 11 is an exploded, perspective assembly view of the muffler of FIG. 9.

Referring now to FIGS. 9, 10 and 11 there is shown an alternative embodiment of muffler 10 and the reference numerals used for explaining the components of muffler 10 shown in FIGS. 1 and 2 and FIGS. 5–8 will likewise be used in describing the same components of muffler 10 shown in FIGS. 9–11. Muffler 10 of FIGS. 9–11 is a simplified version of muffler 10 shown in FIGS. 5–8. The alternative embodiment muffler of FIGS. 9–11 also has four axially extending, annular sound passages 30*a*, 30*b*, 30*c* and 30*d*, but there is no stop plate 45. As a result there are only four sound paths 50*a*, 50*b*, 50*c*, 50*d*.

Specifically a sound wave travels a first path from slot 25 through first passage entrance 42*a* and along the axial distance of first sound passage 30*a* until it strikes outlet end wall section 22 whereat it is reflected and this first path is indicated by a point designated by the reference numeral 50*a*. A sound wave travels a second path from slot 25 through first passage entrance 42*a*, along the axial distance of first sound passage 30*a*, through second passage entrance 42*b* and along the length of second passage 30*b* until it strikes passage end plate 43 whereat it is reflected and this second path is indicated by a point designated by the reference numeral 50*b*. A sound wave travels a third path from slot 25 through third passage entrance 42*c*, along the length of third sound passage 30*c* until it strikes outlet end wall section 22 whereat it is reflected and this third sound path is indicated by the reflection point designated by the reference numeral 50*c*. A sound wave travels a fourth path from slot 25 through third passage entrance 42*c*, along the length of third sound passage 30*c*, through fourth passage entrance 42*d* and along the length of fourth sound passage 30*d* until it strikes inlet end wall section 21 whereat it is reflected and this fourth sound path is indicated by a point designated by the reference numeral 50*d*.

The alternative embodiment of FIGS. 9–11 does not use divider plates 60, 61 so that sound passages 30 extend completely about the circumference of inner and outer casings 12, 16. Also, to form sound passages 30, intermediate cylindrical casings 40 can be affixed to either inlet end wall section 21 as shown by intermediate casing 40*c*, or outlet end wall section 22 as shown by intermediate casing 40*b* or to passage end plate 43 as shown by intermediate casing 40*a*. In summary, while stop plates 45 and divider plates 60, 61 are particularly important and unique aspects of the invention, the inventive muffler shown in its most basic form in FIGS. 1 and 2 will function, in its most basic application form if constructed in accordance with the alternative embodiment illustrated in FIGS. 9–11.

Figure 12:
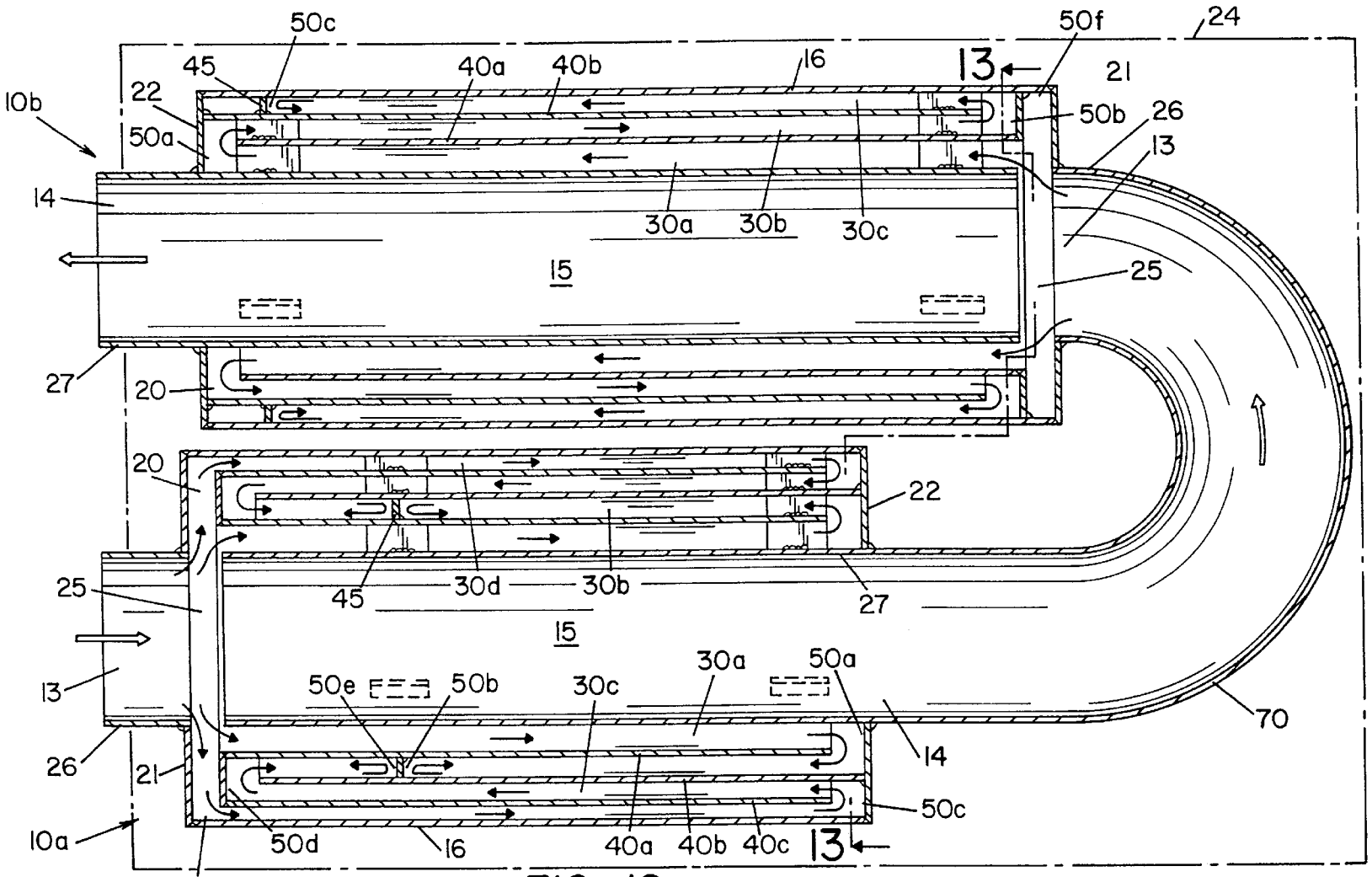
FIG. 12 is an axially sectioned view, similar to FIGS. 5 and 9, of another alternative embodiment of the inventive muffler.
Figure 13:
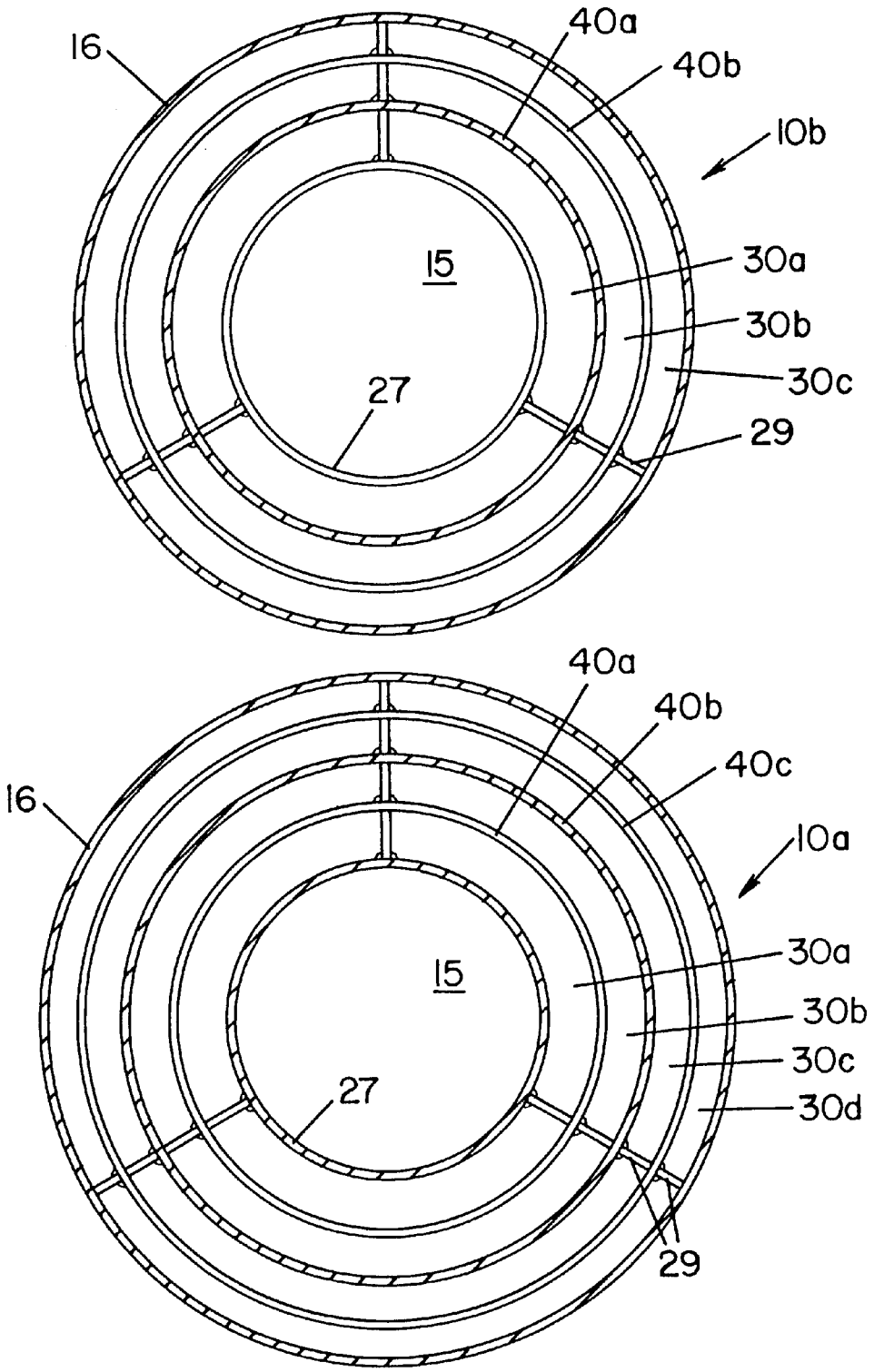
FIG. 13 is a cross-sectioned view of the muffler of FIG. 12 taken along lines 13—13 of FIG. 12.

Referring now to FIGS. 12 and 13 there is shown a still further alternative embodiment of the inventive muffler and the reference numerals used for explaining the components of muffler 10 shown in FIGS. 1–2 and FIGS. 5–8 and FIGS. 9–11 will likewise be used in describing the same components of muffler 10 shown in FIGS. 12–13. In the alternative embodiment of FIGS. 12 and 13, it is shown that muffler 10 can actually comprise a plurality of mufflers connected in series by an extension pipe which can be either straight or folded back onto itself to form a U shaped configuration. As shown in FIG. 12, there are two mufflers 10*a*, 10*b* and the outlet inner casing section 27 of first muffler 10*a* in turn has an extension section 70 folded 180° back unto itself to form a U shape configuration which forms an inlet inner casing section 26 for second muffler 10 *b*. As indicated above, a muffler housing 24 can be optionally provided although this is not necessary.

Both mufflers 10*a*, 10*b* have stop plates 45 but neither muffler has divider plates 60, 61. Muffler 10*a* has sound passages 30 configured in the manner described for muffler 10 illustrated in FIGS. 5–8 and produces five sound paths 50*a*–50*e* as shown and as described with reference to FIGS. 5–8. In addition muffler 10 also produces a short sound path for a high frequency wave which extends from slot 25 to outer casing 16 and is indicated by its reflection point 50*f*.

Muffler 10*b* has three sound passages 30*a*, 30*b* and 30*c* configured in a manner to produce three sound paths indicated by reference numerals 50*a*, 50*b* and 50*c* at the reflection points of the sound paths. In addition muffler 10*b* also has the short sound path 50*f* extending from slot 25 to outer casing 16.

Figure 15:
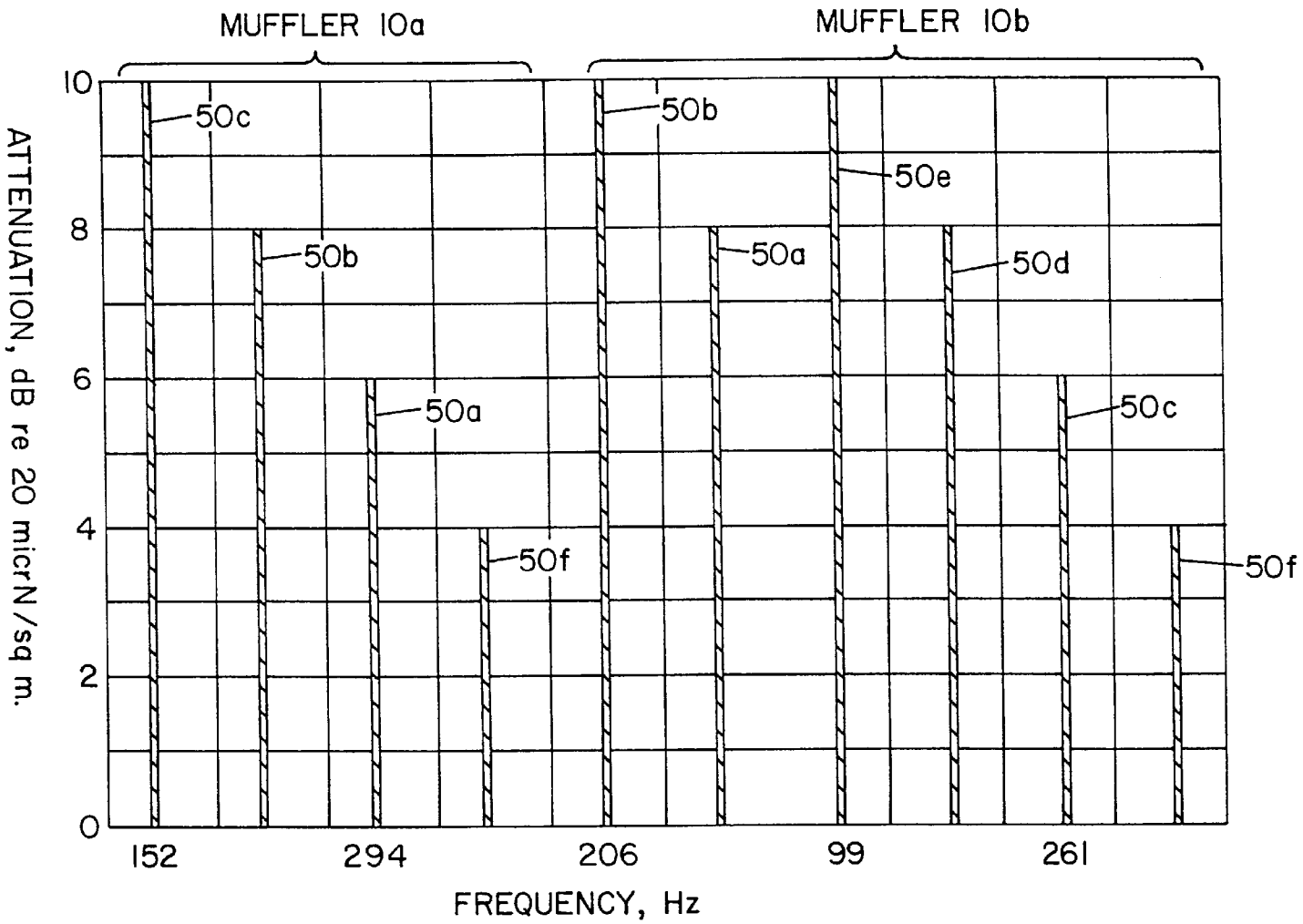
FIG. 15 is a graph of attenuation in decibels plotted on the y-y axis for waves of various frequencies plotted on the x-x axis for the muffler shown in FIG. 12; and, FIG. 16 is a wave attenuation graph similar to that of FIG. 15 for the muffler shown in FIG. 5.

Referring now to FIG. 15 there is shown a graph of the attenuation for the various sound paths described for mufflers 10*a* and 10*b* similar to the graph of FIG. 16 described with reference to muffler 10 shown for FIGS. 5–8. FIG. 15 shows the muffler design is capable of attenuating a number of sound waves and particularly a number of sound waves in the low frequency sound range.

The invention has been described with reference to a preferred and to alternative embodiments. Modifications and alterations will occur to others skilled in the art upon reading and understanding the detailed description of the invention set forth herein. For example the invention has been described with reference to cylindrical and concentric configurations. While this arrangement is distinctly preferred, the invention may function with other tubular shapes and configurations which may not need to completely circumscribe the straight through inner casing. Still further, the sound passages could be utilized in other muffler designs not incorporating a straight through inner casing but employing other muffler concepts such as Helmholtz resonators or sound absorbing materials. Such mufflers may have to be tuned to dampen certain set critical sound waves and the multi-folded side branch design described herein easily lends itself to such application. It is intended to include all such modifications and alterations insofar as they come with the scope of the present invention.

Having thus defined the invention it is claimed:

1. A muffler for attenuating the sounds of combustion gases exhausted from an internal combustion engine comprising:

a tubular inner casing having an inlet in fluid communication with said gases exhausted from said engine and an outlet through which said gases are exhausted to atmosphere, said inner casing axially extending between said inlet and said outlet to define an open ended inner chamber through which said gases freely pass;

an outer casing spaced radially outward from and at least partially circumscribing said inner casing and axially extending substantially the distance between said inlet and said outlet, said outer casing having radial end sections at said inlet and said outlet extending to said inner casing to define a closed ended outer chamber;

slotted opening means providing substantially unimpeded fluid communication between said inner and outer chambers at a set axial position; and, sound attenuation means within said outer chamber for producing reflected waves attenuating at least one sound wave of a set frequency.

2. The muffler of claim 1 wherein said outer chamber completely circumscribes said inner chamber.

3. The muffler of claim 2 wherein said inner and outer casings are cylindrical and concentric with one another whereby said outer chamber is an axially extending annular chamber concentric with said inner chamber.

4. The muffler of claim 3 wherein said axial position for said slotted opening means is at one end of said inner tubular casing.

5. The muffler of claim 3 wherein said slotted opening means includes said inner tubular casing having a first tubular section secured to said inlet and a second tubular section secured to said outlet, each tubular section having an end facing the other section's end and axially spaced from each other a set distance, said axial spacing defining said slotted opening providing fluid communication between said inner and outer chambers.

6. The muffler of claim 5 wherein said sound attenuating means includes a stop plate radially extending between said outer and inner casings, said stop plate set at a fixed axial distance from said slotted opening for attenuating specific sound waves of a frequency correlated to the length of said outer chamber between said stop plate and said slotted opening.

* * * * *